United States Patent [19]

Mary

[11] 4,386,679

[45] Jun. 7, 1983

[54] TRANSFER DEVICE ESPECIALLY FOR PRODUCT CHECKOUT SYSTEMS IN STORES

[75] Inventor: Raymond Mary, Saint Nom la Breteche, France

[73] Assignee: Societe Alser, Saint Cloud, France

[21] Appl. No.: 183,902

[22] Filed: Sep. 4, 1980

[30] Foreign Application Priority Data

Sep. 6, 1979 [FR] France ..... 7922317

[51] Int. Cl.[3] ..... B65G 47/00

[52] U.S. Cl. ..... 186/68; 198/575

[58] Field of Search ..... 186/60, 61, 68, 69; 198/575, 577, 660

[56] References Cited

U.S. PATENT DOCUMENTS 2,536,961 1/1951 Smith ..... 186/68

2,569,711 10/1951 Foster ..... 198/600

3,109,515 11/1963 Schild ..... 186/68

FOREIGN PATENT DOCUMENTS 658322 4/1965 Belgium ..... 186/60

*Primary Examiner*—H. Grant Skagg

*Attorney, Agent, or Firm*—James Creighton Wray

[57] ABSTRACT

A checkout counter associated with the exit till of a store has a registering conveyor belt adjacent the till and a discharge conveyor belt located downstream of the registering belt for distributing checked out products onto an inclined collection surface. The belts are driven by motors with intermittent control. A loading conveyor belt upstream of the registering belt has an independent motor drive. The loading belt frame is connected to the registering belt frame to provide, on the static plane, two separate product reception areas, and, on the dynamic plane, a single transfer track.

5 Claims, 4 Drawing Figures

TRANSFER DEVICE ESPECIALLY FOR PRODUCT CHECKOUT SYSTEMS IN STORES

This invention relates to a device intended to be associated in particular with checkout counter furniture, especially in large-surface stores (supermarkets) serving for the registering of prices and/or reference information on products collected in said store.

We already known of transfer or transport devices, for bulk products, used especially in supermarkets or giant supermarkets. They usually consist of two endless mats arranged one after the other, one of said mats (belts) being arranged in the proximity of a recording till to permit accounting and registering of the price of products purchased, the second mat (conveyor belt) moving the products, which it receives from the till operator, out, after checkout.

The known installations must have a great capacity to permit the rapid checkout of products especially during rush hours, in order to prevent long waiting lines which will drive customers away and which, consequently, can be harmful to the store's profitability.

For this purpose, we have visualized increasing the length of the so-called "registering" conveyor in order to permit a customer to put his product on that same conveyor belt while the operator (checker) checks and registers the products of the preceding client further down the line on this belt.

The solution, however, is not satisfactory because there is a big risk of mixing up products purchased by two successive customers although, in practice, the second customer in reality begins to put his products down on the registering belt only after the registration of the purchases of the preceding client has been completed. Thus, the output of the transportation device is limited not only and above all by the checker's recording speed but also by the speed with which the customers put those products on the belt.

This invention in particular is intended to remedy this inconvenience and for this purpose involves a device consisting of a first registering belt contiguous to the recording till and a second conveyor belt for the discharge of products which have been registered, located down the line from the first belt and distributing said products to an inclined collection surface, each of these two belts being moved by intermittent-control drive means, said device being characterized by the fact that it comprises at least a third endless loading belt, situated up the line from the registering belt and provided with its own drive means, while electrical connection means make it possible to connect this third belt to the registering (checkout) belt so as to constitute, on the static plane, two separate areas for the reception of products and on the dynamic plane, one single transfer track.

According to one preferred version of the invention, the drive means for the endless belts consist of electrical motors supplied from two switches, one of them being connected directly to the registering belt and to the loading belt and indirectly to the discharge belt by means of an automatic time switch, while the other one is directly connected to the registering belt and, by means of the time switch, to the discharge belt.

According to another feature of the invention, the endless registering belt and the loading belt have the same dimension so that they can be assembled end-to-end, while the mechanical means for connecting these two belts can consist of removable (dismantlable) attachment members, such as screws or nuts, and a T-connection, with a removable lid being attached either on the rear frontal face of the registering belt or on that of the loading belt located up the line.

The invention is illustrated by way of example without restrictions in the following drawings, where:

The device is made up in the known manner of a first belt 1, called the "registering belt", situated near the recording till 4 and a second belt 2, the "discharge belt", located down the line from belt 1 and dumping the checked-out products into a reception area made up of an inclined plane 5, said device according to the invention being completed by at least a third belt, called the "loading belt".

Figure 1:
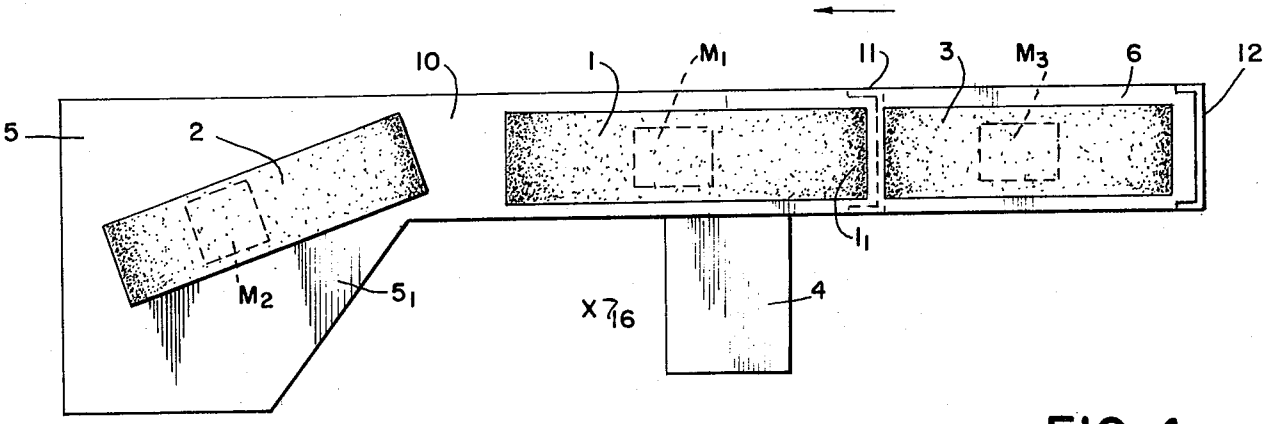
FIG. 1 is a schematic top view of the transfer device according to the invention.
Figure 2:
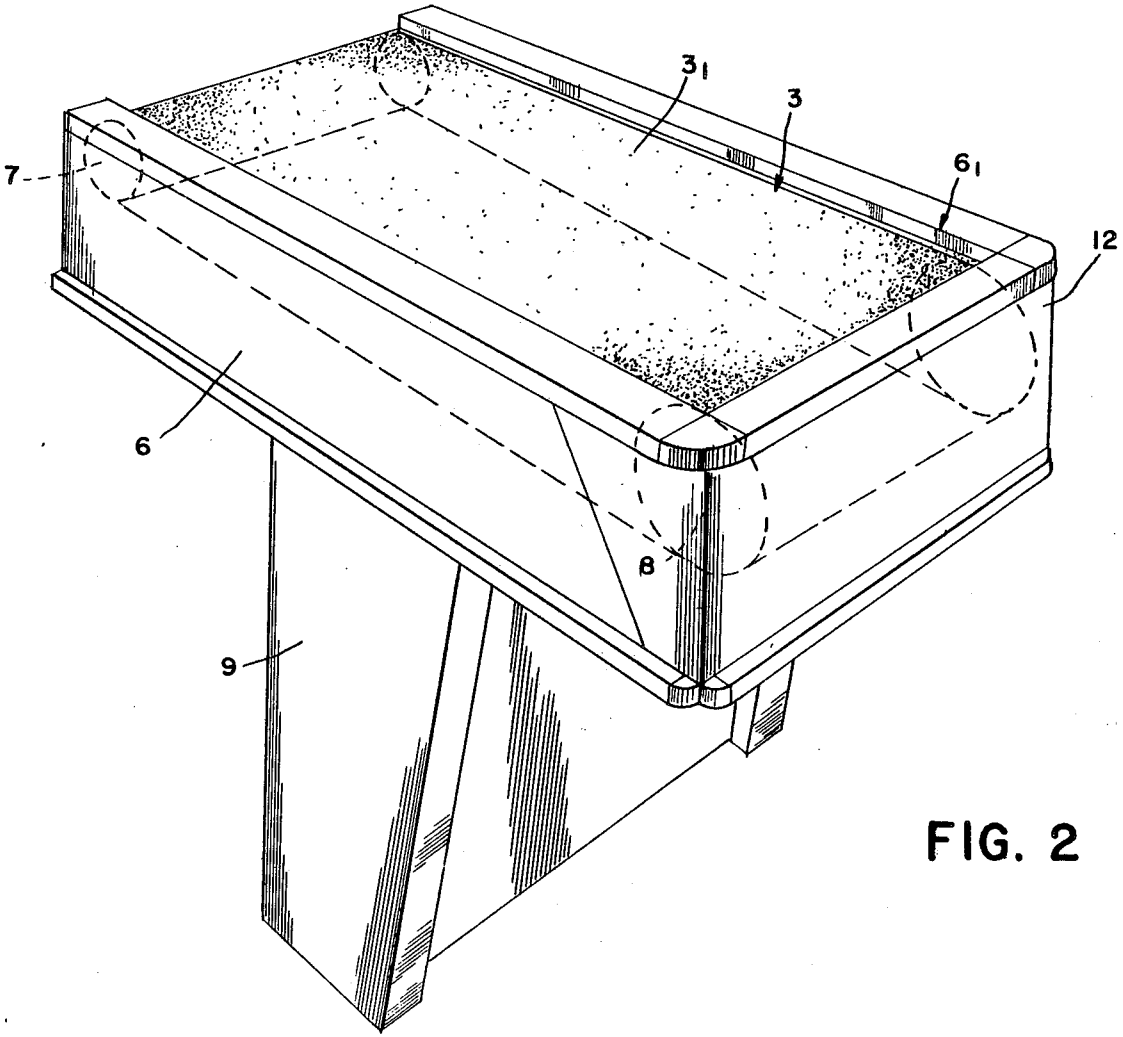
FIG. 2 is a perspective view of the loading belt.

This loading belt, as illustrated in FIG. 2, is supported by a frame assembly 6 in the shape of a box, open in its upper portion $6_1$ in order to allow the upper strand $3_1$ of the endless belt 3, on which are deposited the products purchased by the customer, to appear. This frame assembly encloses an electrical motor (not shown but indicated schematically in FIG. 1), serving to drive the rollers 7 and 8 of endless belt 3, said frame assembly being supported by a support 9 intended to bring the upper strand $3_1$ of the belt up to the same level as the upper strand of belt 1 which is up the line, so that the products can pass from one belt to the other without transition.

This independent belt 3 is connected to the registering belt 1 by a set of mechanical and electrical assembly members and by a connecting link.

Belt 3 is connected to the rear front fact $1_1$ of Belt 1, in the same longitudinal plane, to form one single identical conveyor belt, the mechanical assembly of the independent frame assembly 6 with the fixed framework 10 of belts 1 and 3 being accomplished with the help of removable members, such as clamps or screws and nuts. This assembly takes place after the withdrawal of a removable cover 11, masking the rear front face of frame assembly 10, the dimensions of frame assembly 6 of endless belt 3 being identical to those of frame assembly 10, so that said cover 11 can be fixed on the rear front face 12 of the frame assembly 6 of the loading belt.

Figure 3:
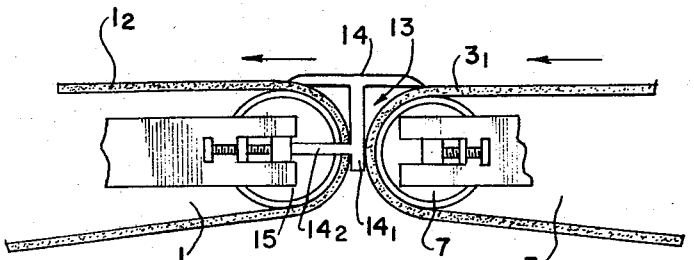
FIG. 3 is a detail side view showing the assembly of the loading belt and the registering belt.

To make sure that the two belts 1 and 3 form a homogeneous whole, permitting the product to pass without transition from one belt to the other, we make sure that the gap 13 (FIG. 3), between the rear frontal face of belt 1 and the forward frontal face of belt 3, will have a minimum width and that this gap will be masked, on the level of upper strands $3_1$ and $1_2$ of belts 1 and 3, by a junction connection 14.

This result is obtained by virtue of the fact that roller 7, situated on the forward frontal face of loading belt 3, has a diameter which is considerably smaller than that of roller 8, located in the vicinity of the rear face of that same belt, its diameter reduction permitting us to get the two rear and forward spaces of belts 3 and 1 to be moved closer together, which consequently reduces the width of the gap 13.

Connecting link 14 is in the form of a T-shaped member which is placed in a plane parallel to rollers 7 and 15 (FIG. 3); the T-shaped member rests on these rollers by means of the two limb portions forming its horizontal arm, while the vertical arm $14_1$ is located in the gap 13. Since the direction of rotation of the belts has a tendency to make the T-shaped member 14 pivot around itself in the clockwise direction, we provide—in order to make sure that the horizontal arm of the member will remain properly in contact with the belts—two angle brackets $14_2$ attached to the vertical arm $14_1$ of the member, said angle brackets abutting on the shaft of drum 15, which makes it possible to keep constant the space between this shaft and the vertical arm $14_1$ of the T-shaped member, regardless of the adjustment of belt tension. Thus, the direction of rotation of the rollers of the belts guarantees the inherent stability of the connecting link 14, so that, on the dynamic plane, endless belts 1 and 3 will form a coherent passage surface permitting the products to pass from one belt to the other without obstacles and without impacts, which is essential especially when the products are fragile.

Belts 1, 2 and 3 are driven by the set of three motors $M_1$, $M_2$, and $M_3$, which have voltage applied to them (from a source not shown) by means of circuits comprising two switches C1 and C2, consisting, for example, of pedals intended to be operated by the till operator 16 who is recording (checking out) the products.

Figure 4:
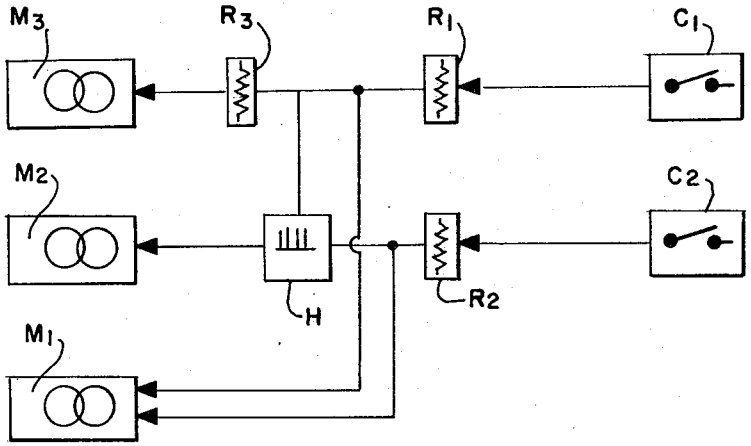
FIG. 4 represents the schematic representation of the electrical elements for the transfer device.

As shown in FIG. 4, switch C1 is connected directly by means of control relays R1-R3 to the two motors M1 and M3 to supply them with power, said same switch C1 being connected indirectly to the third motor M2 by means of relay R2 and an automatic time switch H for supplying power directly to the motor M2, for a predetermined and adjustable time.

Switch C2 is connected directly by means of a relay R2 to motor M1 of registering belt 1, which it is connected to motor M2 of the discharge belt 2 by means of time switch H said motor M2 being set in motion by means of time switch H regardless of the circuit-breaker which may be operated.

The device works in the following manner:

When the till operator activates switch C1, she is simultaneously setting in motion the three endless belts 1, 2 and 3 by applying voltage to their respective motors M1, M2 and M3.

At this stage, the products loaded on belt 3 are moved onto belt 1. The products placed then upon this same belt 1 are scanned and registered by the till operator for billing purposes after which they are placed upon discharge belt 2, which dumps them upon the collection area consisting of the inclined reception surface 5, said surface, in its lowest portion, having a width which is considerably greater than in its highest portion $5_1$.

When the till operator stops activating switch C1, motors M1 and M3 are no longer supplied and their respective registering belt 1 and loading belt 3 are immobilized, while motor M2 is still supplied with power by the self-supply circuit of time switch H which works for a supplementary period of time determined by a timing relay provided in this circuit, so that endless discharge belt 2 continues its passage in order to move the checked-out products to the inclined collection surface.

During registering, the operator must make sure that the products placed on belt 1 are moved along, so that she may scan them, afterward placing them on belt 2 which must likewise be operating to permit the discharge of these products.

This result is obtained by actuating switch C2 which produces a power supply to the motors M1 and M2; the moment the operator stops activating switch C2, belt 1 is immobilized but discharge belt 2 continues to move since it is supplied by time switch H, this time delay action permitting the discharge of the last products recorded.

The device described above presents numerous advantages. In particular, it does away with waiting lines which drive customers away and thus makes it possible to increase the store's profitability. As a matter of fact, on the static plane, the two belts 1 and 3 constitute two separate product reception areas so that the purchases of one customer cannot be mixed up or replaced with those of another customer.

For example, the customer who puts his products on loading belt 3 need not fear that they will get mixed up with those which have been placed by the preceding customer on belt 1 which is used for checkout and registering purposes. On the other hand, the assembly and homogeneity of belts 3 and 1, on the dynamic plane, form one and the same passage surface, the latter being due to the end-to-end line up of belts 1 and 3, with only discharge belt 2 being independent and furthermore, with respect to the longitudinal axis of belts 1 and 3, constituting a certain angle in order to dump and distribute the products essentially in the center of the inclined surface 5.

The importance of the third loading belt 3 resides in the fact that the customer can already put his products down while those of the preceding customer are still being recorded so that the till operator can, without losing time, move the products from belt 3 on to registering belt 1 the moment she has recorded the products of the preceding customer. There is thus no more waiting, such as we had before, and it is quite obvious that one could further increase, if necessary, the profitability of the installation by providing a fourth or fifth belt.

Consequently, the invention is not limited to the addition of a third belt, nor to its arrangement with respect to registering belt 1, because it is evident that one could, for example, arrange loading belt 3 not in the longitudinal axis of belt 1 but along an orthogonal direction.

The invention is thus not limited to the version given here by way of preference and extends to all variations comprised within the framework of the invention.

I claim:

1. Checkout counter apparatus associated with an exit till for registering prices and reference information on articles bought by customers, comprising a registering conveyor belt extending from a first position upstream of said till to a second position within reach of a till operator, a discharge area disposed downstream of said second position for receiving articles from the till operator after they are registered, and at least one loading conveyor belt, said loading conveyor belt having a downstream end aligned with and juxtaposed to the upstream end of said registering belt and said loading belt extending further upstream to receive articles from a customer lining up for checkout, separately actuable electrical drive means for said registering belt and loading belt, and selectively operable actuating means for actuating said registering and loading belts simultaneously to transfer articles from said loading belt to said registering belt, and for actuating said registering belt without actuating said loading belt to move articles along said registering belt without moving articles on said loading belt, wherein said discharge area includes a discharge conveyor belt for receiving registered articles from the till operator and for transfering said articles to an inclined collection surface, further electrical drive means for driving said discharge belt, and timing means responsive to said actuating means for actuating said further drive means during and after operation of said actuating means.

2. Apparatus according to claim 1, wherein there is provided connecting means formed by a T-shaped member which is suspended in a parallel plane between two adjoining rollers of the loading and registering belts, the two limb portions of the horizontal arm of the T-shaped member resting respectively on each of said belts while the vertical arm thereof is disposed in a gap between said rollers, the roller of the loading belt being identical in diameter to the adjoining roller of the registering belt in order to reduce the width of said gap to a minimum, said vertical arm of the T-shaped member being connected to at least one right-angle bracket which bears against a shaft of the adjoining roller to provide for auto-stability of said T-shaped member.

3. Apparatus according to claim 1, comprising a first frame assembly which supports the registering belt, wherein the loading belt is supported by an independent and removable frame assembly which is mechanically coupled to said first frame assembly.

4. Apparatus according to claim 3, wherein the first frame assembly and the removable frame assembly are of the same sectional dimensions so that they can be assembled in an endwise manner, mechanical coupling means for coupling said frame assemblies comprising removable fixing members.

5. Apparatus according to claim 3, wherein the removable frame assembly comprises a housing which is open at its upper portion to expose the upper strand of the loading belt, said removable frame assembly being supported by a base arrangement and enclosing the electric drive means for said loading belt.

* * * * *